US010393114B2

(12) United States Patent
Vacca et al.

(10) Patent No.: US 10,393,114 B2
(45) Date of Patent: Aug. 27, 2019

(54) VARIABLE DELIVERY EXTERNAL GEAR MACHINE

(71) Applicant: Purdue Research Foundation, West Lafayette, IN (US)

(72) Inventors: Andrea Vacca, Lafayette, IN (US); Ram Sudarsan Devendran, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 15/121,586

(22) PCT Filed: Feb. 27, 2015

(86) PCT No.: PCT/US2015/018034

§ 371 (c)(1),
(2) Date: Aug. 25, 2016

(87) PCT Pub. No.: WO2015/131057

PCT Pub. Date: Sep. 3, 2015

(65) Prior Publication Data

US 2016/0369795 A1 Dec. 22, 2016

Related U.S. Application Data

(60) Provisional application No. 61/946,551, filed on Feb. 28, 2014.

(51) Int. Cl.
*F01C 21/00* (2006.01)
*F03C 2/00* (2006.01)
(Continued)

(52) U.S. Cl.
CPC ..... *F04C 14/18* (2013.01); *F01C 1/18* (2013.01); *F01C 20/18* (2013.01); *F01C 21/08* (2013.01);
(Continued)

(58) Field of Classification Search
CPC .. F04C 2/18; F04C 2/086; F04C 14/12; F04C 14/18; F04C 15/06; F04C 2240/30;
(Continued)

(56) References Cited

U.S. PATENT DOCUMENTS 4,902,202 A 2/1990 Bwden
2001/0024618 A1* 9/2001 Winmill ..... F04C 14/185 418/21

(Continued)

FOREIGN PATENT DOCUMENTS

CN 85109203 * 6/1987 ..... F04C 14/185
EP 0478514 1/1991

(Continued)

*Primary Examiner* — Theresa Trieu
(74) *Attorney, Agent, or Firm* — Piroozi-IP, LLC

(57) ABSTRACT

An external gear machine (EGM) includes a housing, an inlet, a drive gear positioned in the housing and configured to be (i) driven by a mechanism when the EGM is operated as a pump, or (ii) drive an external mechanism when the EGM is operated as a motor, the drive gear having a plurality of teeth, a slave gear positioned in the housing having a plurality of teeth and configured to be driven by the drive gear, an outlet formed in the housing and configured to receive at least some of the volume of fluid via an outlet fluid communication channel, a first slider defining an inlet fluid communication channel and the outlet fluid communication channel, selective positioning of the first slider configured to vary net operational volumes of fluid communication between the inlet and the outlet, for a given rotational speed of the drive gear.

19 Claims, 14 Drawing Sheets

(51) Int. Cl.

| | |
|---|---|
| ***F03C 4/00*** | (2006.01) |
| ***F04C 2/00*** | (2006.01) |
| ***F04C 14/18*** | (2006.01) |
| ***F04C 2/08*** | (2006.01) |
| ***F04C 2/18*** | (2006.01) |
| ***F03C 2/08*** | (2006.01) |
| ***F04C 14/12*** | (2006.01) |
| ***F04C 15/06*** | (2006.01) |
| ***F01C 1/18*** | (2006.01) |
| ***F01C 20/18*** | (2006.01) |
| ***F01C 21/08*** | (2006.01) |
| ***F01C 21/10*** | (2006.01) |
| ***F01C 21/18*** | (2006.01) |

(52) U.S. Cl.
CPC ..... *F01C 21/10* (2013.01); *F01C 21/18* (2013.01); *F03C 2/08* (2013.01); *F04C 2/086* (2013.01); *F04C 2/18* (2013.01); *F04C 14/12* (2013.01); *F04C 15/06* (2013.01); *F04C 2240/30* (2013.01)

(58) Field of Classification Search
CPC .... F03C 2/08; F01C 1/18; F01C 20/18; F01C 21/18; F01C 21/08; F01C 21/10
USPC ..... 418/189–190, 206.1–206.8, 21
See application file for complete search history.

(56) References Cited

U.S. PATENT DOCUMENTS

2002/0104313 A1* 8/2002 Clarke ..... F16D 31/04 60/419
2008/0044308 A1* 2/2008 Hoji ..... F04C 2/18 418/206.1

FOREIGN PATENT DOCUMENTS

EP 0478514 * 4/1992 ..... F04C 14/185
GB 968998 * 9/1964 ..... F04C 2/086

* cited by examiner

VARIABLE DELIVERY EXTERNAL GEAR MACHINE

CROSS-REFERENCE TO RELATED APPLICATIONS

The present U.S. patent application is a 35 U.S.C. § 371 national phase application of PCT/US2015/018034, filed Feb. 27, 2015, which is related to and claims the priority benefit of U.S. Provisional Patent Application Ser. No. 61/946,551, filed Feb. 28, 2014, the contents of which is hereby incorporated by reference in its entirety into the present disclosure.

GOVERNMENT SUPPORT CLAUSE

This invention was made with government support under EEC0540834 awarded by the National Science Foundation. The government has certain rights in the invention.

TECHNICAL FIELD

The present application relates to gear machines, and specifically to external gear machines used in fluid power management systems.

BACKGROUND

This section introduces aspects that may help facilitate a better understanding of the disclosure. Accordingly, these statements are to be read in this light and are not to be understood as admissions about what is or is not prior art.

External gear machines (EGMs) are used as primary flow supply unit in many applications such as fuel injection systems, small mobile applications such as micro-excavators, turf, and gardening machines. EGMs are also used in fixed applications such as hydraulic presses and forming machines. EGMs also find applications in auxiliary systems such as hydraulic power steering, fan drive systems and as charge pump in hydrostatic transmissions.

Referring to FIG. 1A, a perspective view of an example of an EGM 10 is depicted. The EGM 10 includes a housing 12, a drive gear 14, which drives a slave gear 16, both disposed inside the housing 12. The drive gear 14 and the slave gear 16 are supported by bushings 18 inside the housing 12. The drive gear 14 and the slave gear 16 are coupled together in a mesh zone where a plurality of their respective teeth comes into contact with each other. Tooth space volumes between any two consecutive teeth of the drive gear 14 and any two consecutive teeth of the slave gear 16 pick up fluid and deliver fluid as the teeth rotate about the housing 12. Specifically, in the mesh zone the tooth space volumes initially decrease as the respective teeth come into contact with each other and increase as the teeth come apart from each other. As the tooth space volume decreases, fluid pressure increases, causing ejection of fluid through an outlet 22 at an output pressure. Similarly, as the volume increases, the pressure decreases causing suction of fluid from the inlet 24 at an inlet pressure. End caps 26 and 28 enclose the housing 12, where the end cap 26 provides a journal support for the drive gear 14.

Referring to FIG. 1B, a perspective view of an example of the bushing 18 is provided. Fluid is communicated via an outlet fluid communication channel in the form of a groove 30 from the varying spaces between the teeth in the mesh zone to the outlet; and similarly fluid is communicated via an inlet fluid communication channel in the form of a groove 32 to the varying spaces between the teeth in the mesh zone from the inlet. Therefore, grooves permit to utilize the full volumetric capacity of the unit, avoiding localized pressure peaks and fluid cavitation. In a pressure compensated EGM, such as the one represented in FIG. 1A, these grooves are realized in the bushings 18 (FIG. 1B)—popularly known by the names of bearing blocks and pressure/thrust plates—used to realize optimal sealing of the tooth space volumes through a proper lubricating fluid film even at high operating pressures. In non-compensated EGM, these grooves are machined in the pump housing.

The above described principle of operation of an EGM makes these units inherently fixed displacement. This inability of adapting the fluid displaced per every revolution on the basis of user's requests makes EGMs unsuitable for applications in energy efficient system layout configurations which characterize many fluid power applications. In these system configurations, variable displacement units can offer energy saving even greater than 50% compared to solutions based on fixed displacement units.

These factors have driven significant research towards the definition of a working concept for variable displacement EGMs. Past effort can be broadly categorized into two different sets of solutions: the first set of solutions consists of changing the meshing length of the gears. Several patent references describe different solutions for this idea, by moving the gears axially (US2001024618, EP0478514, US2008044308, and US2002104313). The second set of solutions consists in changing the inter-axis distance between the gears, thereby affecting the meshing area of the gears as provided in at least two patent references (CN85109203 and GB968998). However, each of these solutions introduces significant technological challenges, such as complexity, and has not resulted in successful commercialization. In fact, several major issues have to be faced to implement a viable and cost effective solution to move the gears, which are the most mechanically loaded parts of the machine, requiring at the same time good sealing and smooth transmission of power between the gears.

Efforts to obtain variable flow supply units were also made at system level; in particular, solutions that combine fixed displacement pumps with fast switching valves controlled in pulse width modulation (PWM) to obtain a variable output flow were proposed by several researchers. Despite the theoretical validity of these so called "virtually variable displacement" solutions, their application in real systems is hampered by the limited time response of electromechanical valves as well as compatibility issues of current fixed displacement pumps with the introduction of severe pressure pulsations.

There is, therefore an unmet need for a novel approach to provide variable flow at low and high pressures in gear pumps.

SUMMARY

An external gear machine (EGM) is disclosed. The EGM includes a housing, an inlet formed in the housing and configured to receive fluid from a supply, a drive gear positioned in the housing and configured to be (i) driven by a mechanism when the EGM is operated as a pump, or (ii) drive an external mechanism when the EGM is operated as a motor, the drive gear having a plurality of teeth. The EGM further includes a slave gear positioned in the housing having a plurality of teeth and configured to be driven by the drive gear, the drive gear configured to engage the slave gear in an angular mesh zone, tooth space volumes defined by tooth spaces between each two consecutive teeth of the drive gear and each two consecutive teeth of the slave gear configured to receive volumes of fluid from the inlet via an inlet fluid communication channel as the corresponding teeth rotate about the inlet. In addition, the EGM includes an outlet formed in the housing and configured to receive at least some of the volume of fluid via an outlet fluid communication channel when the corresponding tooth space volumes in the angular mesh zone decrease as the corresponding teeth of the drive gear and slave gear come into contact with each other. The EGM also includes a first slider defining the inlet fluid communication channel and the outlet fluid communication channel, selective positioning of the first slider configured to vary net operational volumes of fluid communication between the inlet and the outlet, for a given rotational speed of the drive gear.

According to one embodiment, the teeth of the EGM are asymmetrical.

According to one embodiment, the asymmetry of each tooth is defined by a first angle between a first face of the tooth in relationship with a first radial line and by a second angle between a second face of the tooth in relationship with a second radial line.

According to one embodiment, the ratio of the first angle to the second angle is between about 1 and 1.81.

According to one embodiment, the EGM further includes a second slider (also having grooves similar to those in the first slider) defining a secondary inlet fluid communication channel and a secondary outlet fluid communication channel such that selective positioning of the second slider provides fluid cooperation with the inlet fluid communication channel and the outlet fluid communication channel in order to vary net operational volumes of fluid communication between the inlet and the outlet, for a given rotational speed of the drive gear.

According to one embodiment, the second slider and the first slider are operatively coupled to each other.

According to one embodiment, the first slider is operated by an electromechanical actuator.

According to one embodiment, the electromechanical actuator is a stepper motor.

According to one embodiment, the electromechanical actuator is a solenoid.

According to one embodiment, the first slider is operated by a mechanical actuator configured to move the first slider based on one of (i) pressure differential between the inlet and the outlet, (ii), pressure at the outlet, and (iii) a combination thereof.

A hydraulic displacement system (HDS) is also disclosed. The HDS includes a mechanism for (i) driving an external gear machine (EGM) when the EGM is configured to be a pump, or (ii) being driven by the EGM when the EGM is configured to be a motor. The HDS also includes a fluid supply. The HDS also includes an EGM. The EGM includes a housing, an inlet formed in the housing and configured to receive fluid from a supply, a drive gear positioned in the housing and configured to be (i) driven by the mechanism when the EGM is operated as a pump, or (ii) drive the mechanism when the EGM is operated as a motor, the drive gear having a plurality of teeth, a slave gear positioned in the housing having a plurality of teeth and configured to be driven by the drive gear, the drive gear configured to engage the slave gear in an angular mesh zone, tooth space volumes defined by tooth spaces between each two consecutive teeth of the drive gear and each two consecutive teeth of the slave gear configured to receive volumes of fluid from the inlet via an inlet fluid communication channel as the corresponding teeth rotate about the inlet, an outlet formed in the housing and configured to receive at least some of the volume of fluid via an outlet fluid communication channel when the corresponding tooth space volumes in the angular mesh zone decrease as the corresponding teeth of the drive gear and slave gear come into contact with each other and a first slider defining the inlet fluid communication channel and the outlet fluid communication channel, selective positioning of the first slider configured to vary net operational volumes of fluid communication between the inlet and the outlet, for a given rotational speed of the drive gear.

According to one embodiment, the teeth are asymmetrical.

According to one embodiment, the asymmetry of each tooth is defined by a first angle between a first face of the tooth in relationship with a first radial line and by a second angle between a second face of the tooth in relationship with a second radial line.

According to one embodiment, the ratio of the first angle to the second angle is between about 1 and 1.81.

According to one embodiment, the EGM further includes a second slider defining a secondary inlet fluid communication channel and a secondary outlet fluid communication channel such that selective positioning of the second slider provides fluid cooperation with the inlet fluid communication channel and the outlet fluid communication channel in order to vary net operational volumes of fluid communication between the inlet and the outlet, for a given rotational speed of the drive gear.

According to one embodiment, the second slider and the first slider are operatively coupled to each other.

According to one embodiment, the first slider is operated by an electromechanical actuator.

According to one embodiment, the electromechanical actuator is a stepper motor.

According to one embodiment, the electromechanical actuator is a solenoid.

According to one embodiment, the first slider is operated by a mechanical actuator configured to move the first slider based on one of (i) pressure differential between the inlet and the outlet, (ii), pressure at the outlet, and (iii) a combination thereof

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1A:
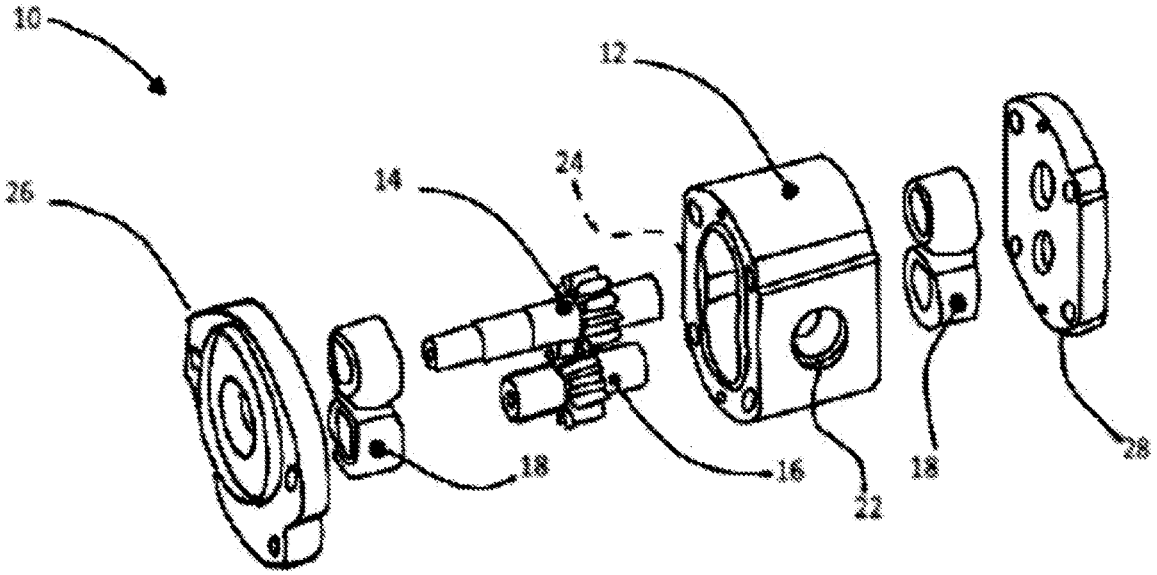
FIG. 1A (Prior Art)
FIG. 1A depicts a perspective view of a prior art external gear machine (EGM).
Figure 1B:
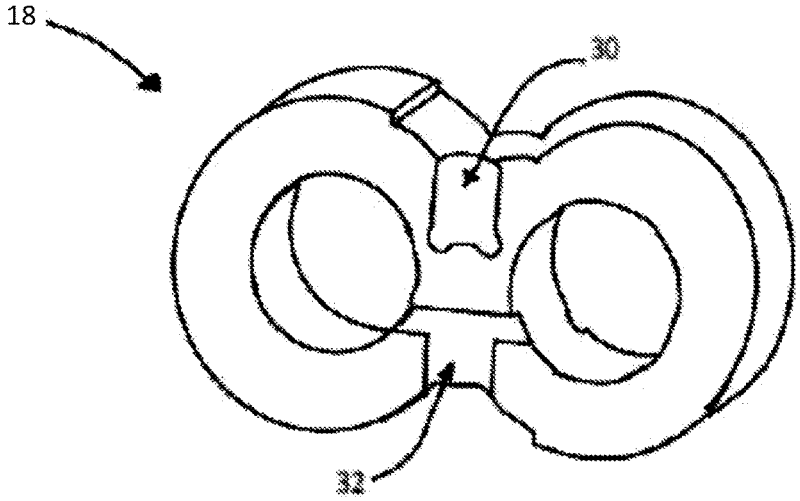
FIG. 1B (Prior Art)
FIG. 1B depicts a perspective view of a bushing in the external gear machine of FIG. 1A.

The attached drawings are for purposes of illustration and are not necessarily to scale.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

A novel approach for varying flow rate through an external gear machine (EGM), formed as a pump or motor, is described in the present disclosure. The external gear machine according to the present disclosure provides variable timing for fluid transfer from an inlet to an outlet of the machine. The described solution preserves the compactness, reliability and low cost features typical of an EGM and achieves control of flow displaced by the machine. The novel design concept further takes advantage of asymmetric involute and trochoid profiles of gears, which are used to maximize the range of flow variation achievable by the machine. The proposed design is also optimized to maximize the performance levels, in terms of delivery flow pulsations—typically responsible for noise emissions and vibrations—volumetric efficiency, internal pressure peaks and cavitation onset which occur during the meshing process of the gear of the EGM.

Figure 2:
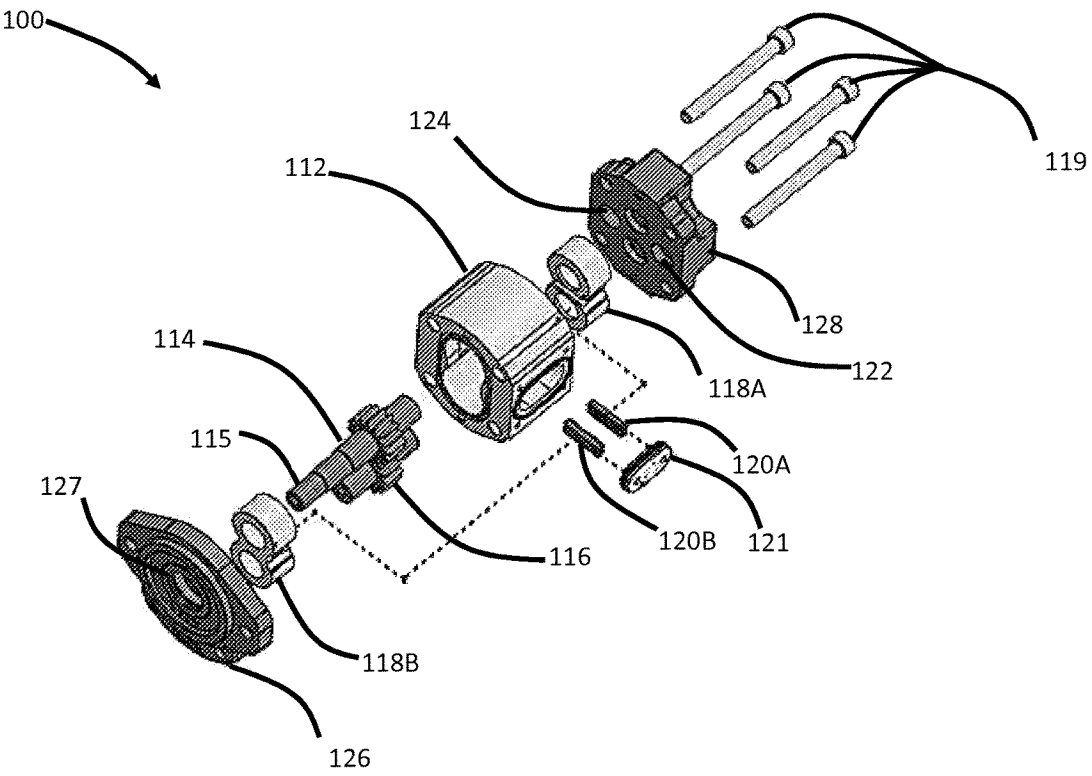
FIG. 2 depicts a perspective view of an EGM according to the present disclosure.

Referring to FIG. 2, an exploded perspective view of an EGM 100, according to the present disclosure, is presented. The EGM 100 includes a housing 112, a drive gear 114, which drives a slave gear 116, both disposed inside the housing 112. The drive gear 114 and the slave gear 116 are supported by bushings 118A and 118B inside the housing 112. The drive gear 114 and the slave gear 116 are coupled together in a mesh zone (depicted in FIG. 3) where a plurality of their respective teeth comes into contact with each other. End caps 126 and 128 enclose the housing 112 and coupled to the housing by fasteners 119, where the end cap 126 provides a journal support 127 for endshaft 115 of the drive gear 114. The EGM 100 also includes an outlet 122 and an inlet 124. The EGM also includes end caps 126 and 128, The EGM 100 also includes sliders 120A and 120B. These sliders 120A and 120B are coupled to the respective bushings 118A and 118B. A sealing member is fastened to the housing 120. The positioning and coupling of the sliders 120A and 120B with respect to the bushings 118A and 118B is described below with reference FIG. 3.

Figure 3:
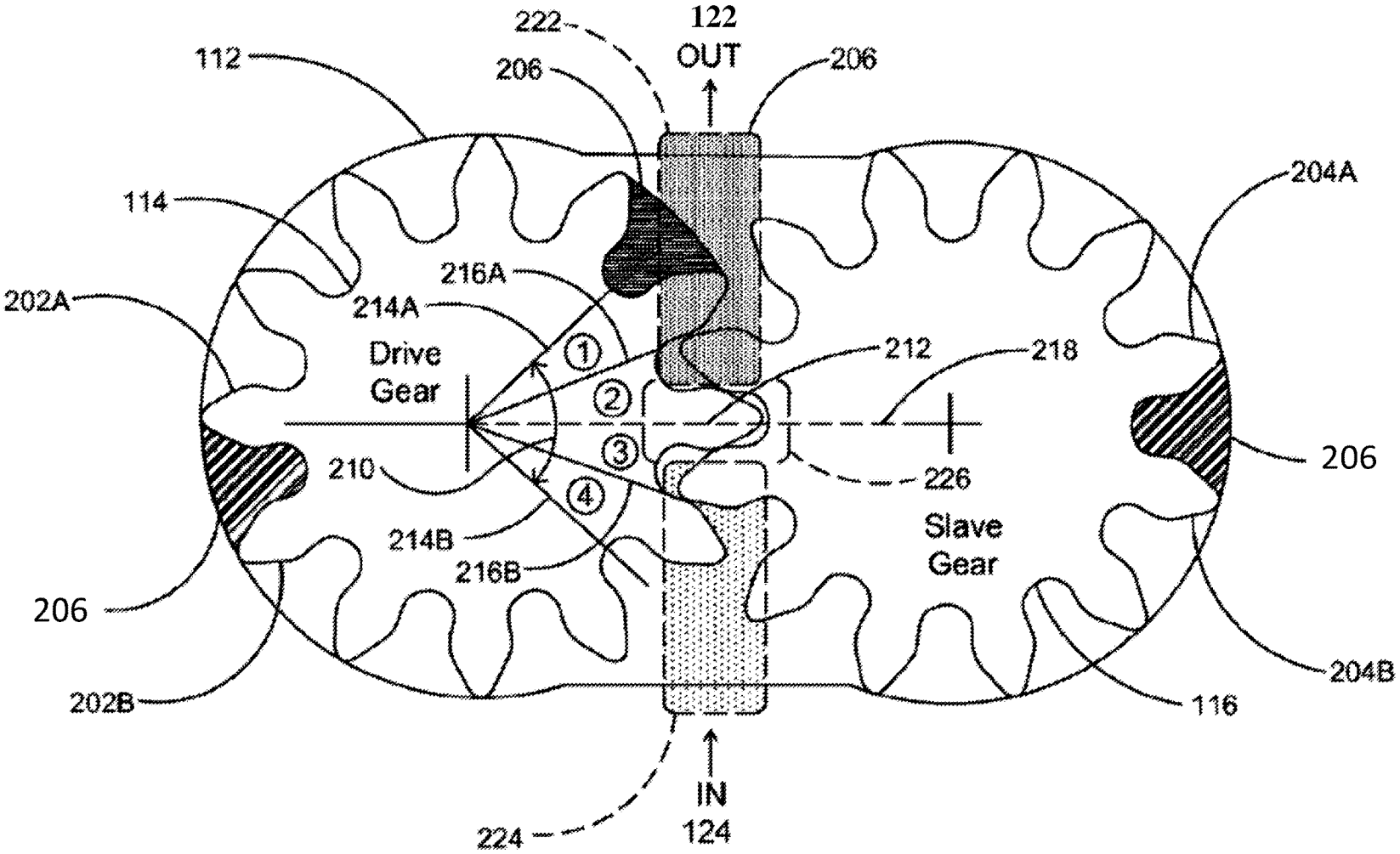
FIG. 3 is a front view of a drive gear and a slave gear found in the EGM of FIG. 2 engaged in a typical configuration.

Referring to FIG. 3, a plane view of the drive gear 114 and the slave gear 116 in engagement with each other is provided. The drive gear 114 has a plurality of teeth, exemplified by 202A and 202B, while the slave gear 116 also has a plurality of teeth, exemplified by 204A and 204B. Tooth space volume 206 is identified as the space between any two consecutive teeth. Within this space, fluid is picked up and then trapped between any two consecutive teeth of the drive gear 114 and any two consecutive teeth of the slave gear 116 and the housing 112. The engagement of the teeth creates a mesh zone 210 identified as the angular portion θ. It should be noted that the tooth space volume 206 is a variable that is constant for most of its rotational path but begins to decrease and then increase within the mesh zone 210.

The mesh zone is divided into four portions. The first portion (identified as 1 in a circle) is the upper portion in FIG. 3, where the teeth just begin to engage each other. This portion is identified as the space between mesh-zone-start 214A and upper-exterior-portion 216A. As the teeth from both the drive gear 114 and the slave gear 116 come together in the first portion of the mesh zone (1), the space volumes 206 of the respective gears begin to interfere with each other and the overall tooth space volumes 206 decrease. As the tooth space volumes 206 decrease, fluid pressure increases, causing ejection of fluid through the outlet 122 at an output pressure. At this point fluid begins to be ejected from the EGM 100 via an outlet grove 222 (also referred to as the outlet fluid communication channel), identified in dashed lines for clarity, positioned below the mesh zone 210 as well as openings (not shown) to the outlet 122. The bottom of the first portion is identified by the point "D" which signifies a point in the rotation where the teeth have trapped the fluid in the associated tooth space volumes 206 as a result of contact with each other. Beyond point "D" the only path for ejection of fluid is through the outlet groove 222 to the outlet 122. In other words, point "D" corresponds to the switch point between i) fluid ejection via the outlet groove 222 and other openings (not shown) to ii) fluid ejection via the outlet groove 222 only by isolating tooth space volumes 206 with the outlet groove 222.

The second portion (identified as 2 in a circle) is the upper-interior portion in FIG. 3. This portion is identified as the space between the upper-exterior-portion 216A and the centerline 218. As the tooth space volume decreases, fluid pressure increases. In this portion the teeth come in contact with each other and trap the fluid within the shrinking tooth space volume 206. Somewhere in this portion (2), the outlet groove ends, at which point fluid is no longer able to be ejected via the outlet groove 222. At the center 212 of mesh zone 210 the tooth space volumes 206 are minimized. At any point beyond the center 212, the tooth space volume 206 begins to increase.

The third portion (identified as 3 in a circle) is the lower-interior portion in FIG. 3. This portion is identified as the space between the centerline 218 and lower-exterior-portion 216B. In this portion the teeth remain in contact with each other and continue to trap the fluid, however, now the tooth space volumes 206 begin to increase. Somewhere in this portion (3), an inlet groove 224 (also referred to as the inlet fluid communication channel), shown in dashed lines for clarity, ends; at which point fluid that is isolated to the inlet groove 224 can begin to be sucked in via the inlet groove 224 from the inlet 124. The end of portion 3 is designated as "S" in FIG. 3, corresponding to a switch point between i) fluid suction via the inlet groove 224 only by isolating tooth space volumes 206 with the inlet groove 224 to ii) fluid suction via the inlet groove 224 and other openings (not shown) to the inlet 124.

The fourth portion (identified as 4 in a circle) is the lower portion in FIG. 3, where the teeth just begin to separate from each other. This portion is identified as the space between lower-exterior-portion 216B and mesh-zone-end 214B. As the teeth from both the drive gear 114 and the slave gear 116 come apart from each other in the fourth portion of the mesh zone (4), the space volumes 206 of the respective gears continue to expand. As the tooth space volumes 206 increase, the fluid pressure decreases causing suction of fluid from the inlet 124 at an inlet pressure. At this point fluid continues to be sucked into the EGM 100 via the inlet grove 224 positioned below the mesh zone 210 as well as openings (not shown) to the inlet 124.

A no-fluid-communication-zone 226 is depicted between the bottom of the outlet groove 222 and the top of the inlet groove 224. This zone 226 corresponds to an angular space in which fluid is not communicated to either the inlet or the outlet. Minimizing this zone 226, maximizes fluid displacement, however, too much of this zone 226, can cause pressure spikes and cavitation resulting in noise and other mechanical issues.

Figure 4:
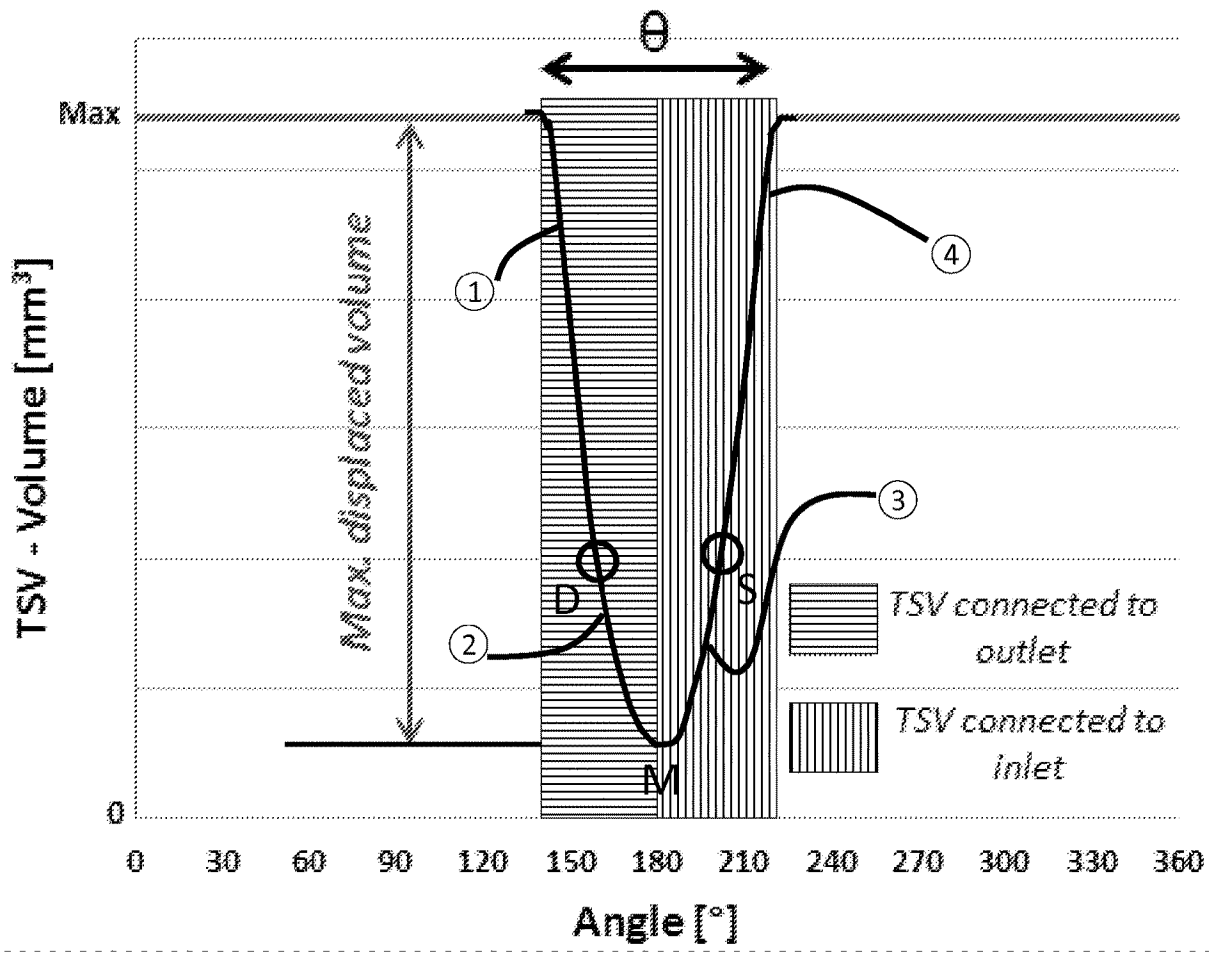
FIG. 4 is a graph of tooth space volume measured in $mm^3$ vs. Angle measured in degrees.

Referring to FIG. 4, a graph of tooth space volume vs. angular position for the arrangement depicted in FIG. 3 is provided. The aforementioned four portions of the mesh zone 210 are marked in successive numbering from 1 to 4. In portions 1 and 2, fluid is ejected from the EGM 100. In portions 3 and 4 fluid is sucked into the EGM 100. The lowest point of the graph (marked as M), represents a switching point where fluid is no longer ejected but begins to be sucked in. The point M coincides with the centerline 218 and the center 212 in FIG. 3.

Figure 5:
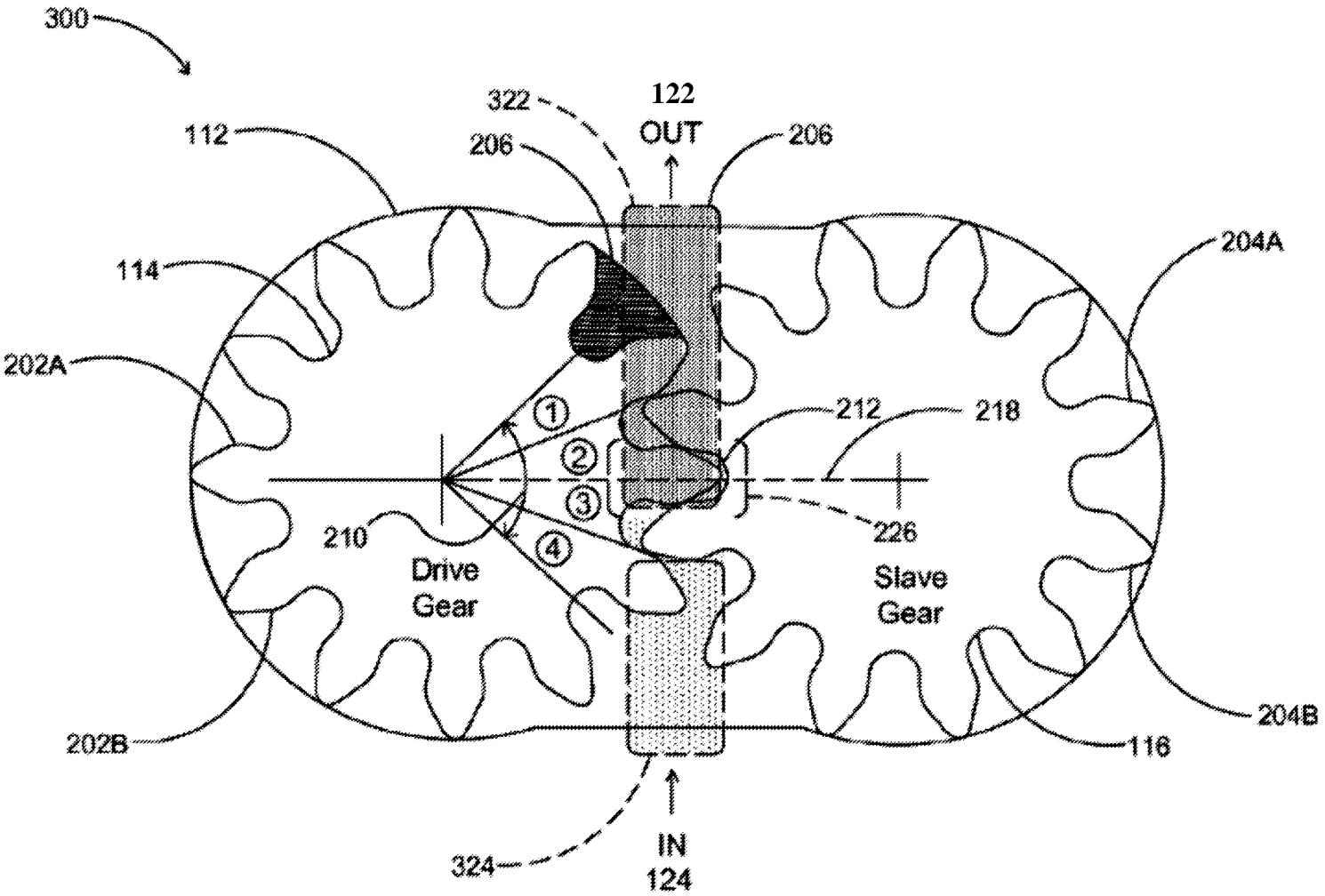
FIG. 5 is a front view of the drive gear and the slave gear found in the EGM of FIG. 2 engaged in a particular configuration according to the teachings of the present disclosure.

Referring to FIG. 5, a gear interface 300 is presented that according to the present disclosure provides for a different fluid transfer than what is provided in FIG. 3. There are two main differences between the gear arrangements in FIGS. 3 and 5, firstly the disposition of the outlet groove 222 vs. 322 in which the outlet groove 322 (also referred to as the outlet fluid communication channel) is elongated into the no-fluid-communication-zone 226. Secondly, the inlet groove 324 differs from 224, wherein inlet groove 324 (also referred to as the inlet fluid communication channel) is shortened away from the no fluid communication-zone 226. The elongation of the outlet groove 322 as well as the simultaneous shortening of the inlet groove 324, results in a reduced flow delivery (equivalent to a lower pump displacement). This flow reduction is because during the portion 2 of the mesh zone 210 and part of the portion 3 of the mesh zone 210, each tooth space volume 206 remains coupled to the outlet port 122 via the outlet groove 322 while the tooth space volumes 206 decrease and then while the tooth space volumes 206 begin to expand. As a result a part of the fluid already delivered to the outlet is taken back into the tooth space volumes 206 via the outlet groove 322 which acts as a "fluid dead volume." This "dead volume" in effect varies the net operational volume that passes through the EGM. Net operational volume is defined as the net volume of fluid sucked into the EGM from the inlet 124 and the volume of fluid ejected to the outlet 122 (considering the fluid dead volume). Graphically, the principle can be represented by a larger (as compared to FIG. 4) portion coupled to the outlet. The additional "dead volume" is equal to the difference between the volumes of points S and M, therefore the effective fluid displaced to the outlet is equal to the difference between the maximum volume and volume at point S.

Figure 6:
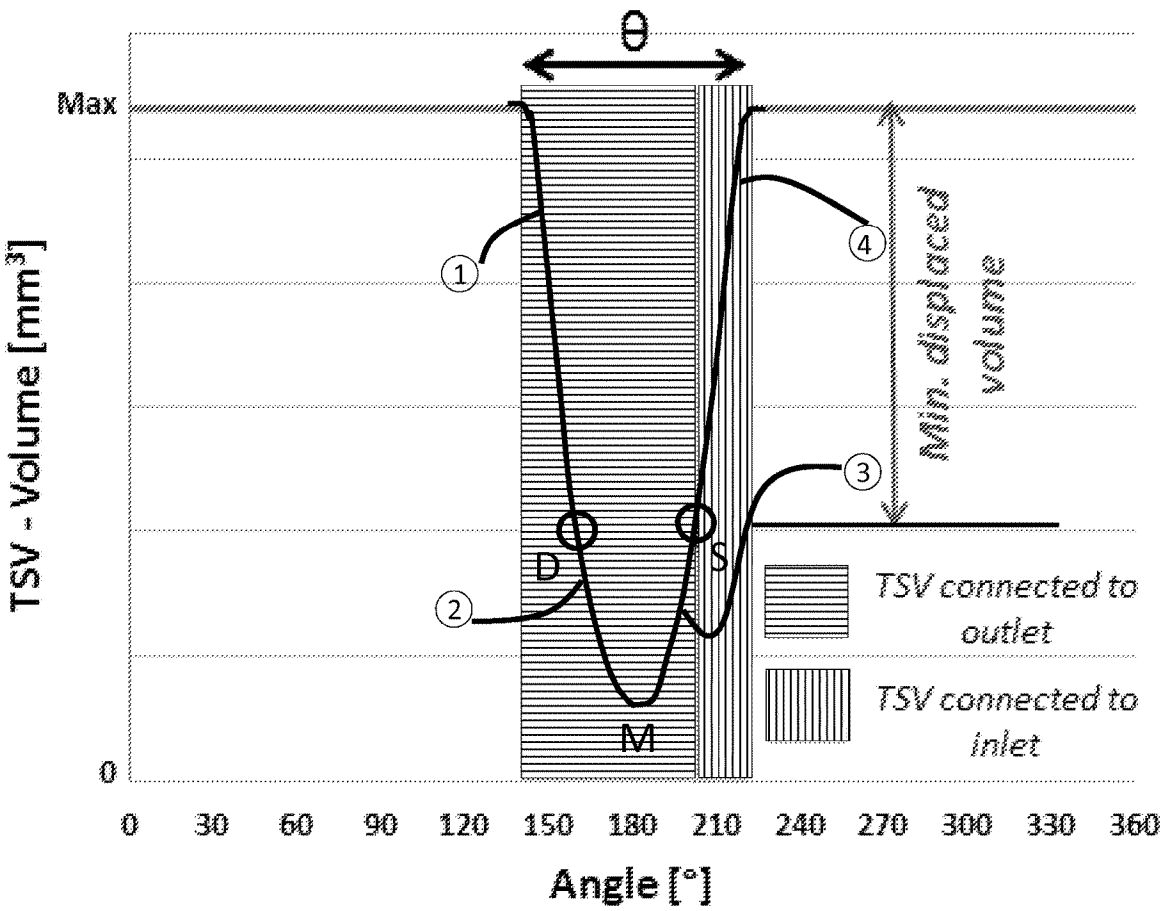
FIG. 6 is a graph of tooth space volume measured in $mm^3$ vs. Angle measured in degrees, distinguishing the arrangement shown in FIG. 5.
Figure 7:
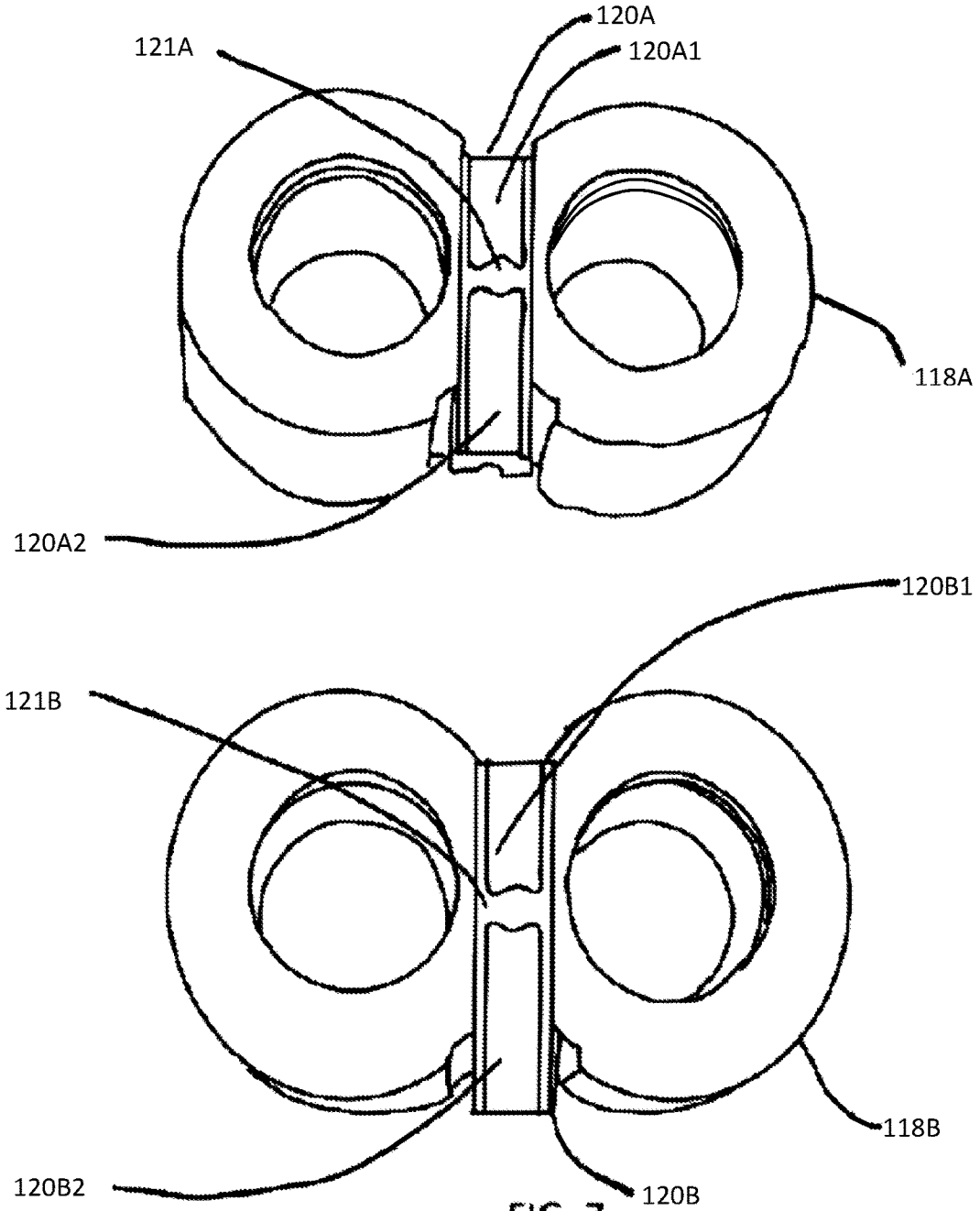
FIG. 7 represents perspective views of a bushing with a slider disposed thereon at different positions.

While the difference between FIGS. 3 and 5 and the associated graphs provided in FIGS. 4 and 6 have been based on elongation of the outlet grooves 322 as well as the shortening of the inlet grooves 324, the same effect can be provided by providing the inlet groove and the outlet groove on sliders that can be moved with respect to the centerline 218. The sliders 120A and 120B were shown in FIG. 2. The inlet and outlet grooves can be machined in these sliders 120A and 120B to provide a path for fluid communication to the outlet 122 and the inlet 124. Referring to FIG. 7 the sliders 120A and 120B are shown in their respective slots within the bushing 118A and 118B, respectively. Therefore, with respect to FIG. 3, the elongation of the outlet groove 222 to the outlet groove 322 along with the simultaneous shortening of the inlet groove 224 to the outlet groove 324, shown in FIG. 5, can be achieved by sliding the sliders 120A and 120B downward towards the inlet 124. As seen in FIG. 7, each slider 120A and 120B includes an outlet groove 120A1 and 120B1, respectively, that are configured to couple tooth space volumes to the outlet 122; and an inlet groove 120A2, and 120B2, respectively, which are configured to couple the tooth space volumes to the inlet 124. Each slider 120A and 120B also includes a switch zone 121A and 121B, respectively, configured to switch between ejecting fluid to the outlet 122 and sucking fluid from the inlet 124.

To realize delivery flow variation, the slider can move either towards the inlet port 124 or towards the outlet port 122. However, being the conditions of the fluid at the inlet port is often close to saturation (for the case of a pump); it is preferable to consider the motion towards the inlet port, so that cavitation effects due to fluid aeration are limited. The opposite consideration applies for the case of a motor (a distinction between motors and pumps will be made further in the present disclosure).

It should be appreciated how the variation of the achieved flow delivery as a result of change in slider position of sliders 120A and 120B can occur for all slider positions that realize the described switching between the points D and S, in which each tooth space volume is trapped between points of contact of the teeth. By moving the slider outside the limits D-S a direct bypass connection between the outlet and the inlet would be realized, hence significantly reducing the volumetric efficiency of the variable delivery (VD)-EGM. With symmetric gears, the points D and S lie very closely to point M and hence they do not offer a large variation in the displacement, therefore novel asymmetric gear profiles are used to maximize the reduction in displacement.

Figure 8A:
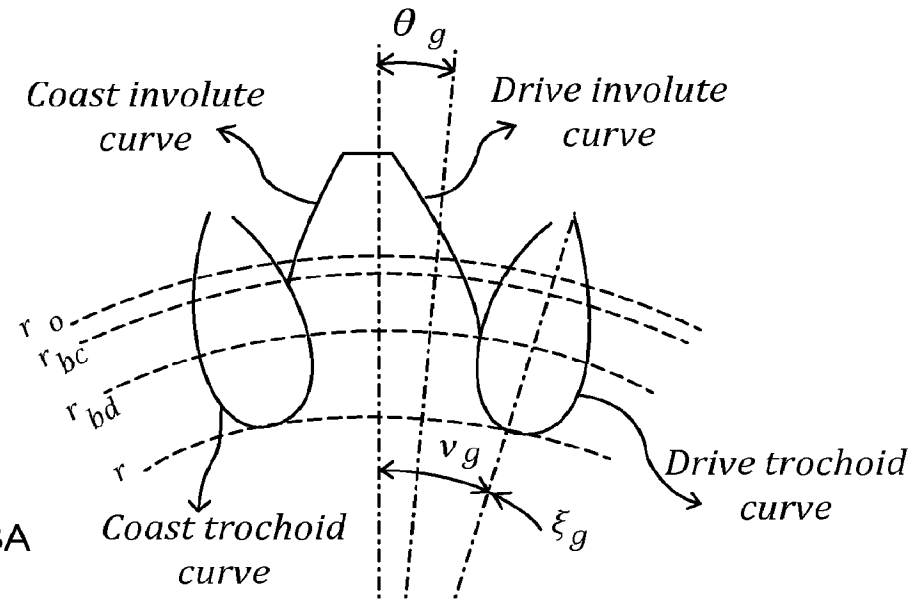
FIGS. 8A and 8B are schematic representations of gear teeth and the cutter for generating the gears, respectively.
Figure 8B:
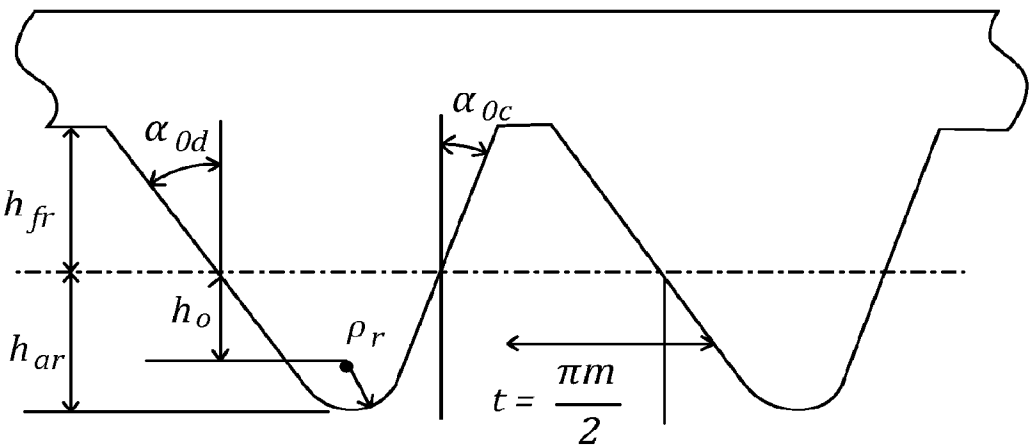

Gears with asymmetric teeth profile, unconventional for EGMs, were investigated with the particular aim of maximizing the range of displacement variation achievable for the (VD)-EGM. The design of the teeth includes involute and trochoid profiles above and below the base circle, respectively. In order to accomplish the goal of designing asymmetric teeth, two different pressure angles are considered respectively for the drive and opposite coast tooth flanks as shown in FIG. 8A. In order to ensure that the asymmetrical teeth gear profile is physically manufacturable using conventional manufacturing processes such as hobbing, shaping, rack-cutting etc., an asymmetrical cutter profile is assumed at first. The tooth profile is then derived on the basis of the shape of the asymmetric cutter as shown in FIGS. 8A and 8B.

Based on the design variables, the parameters which govern the shape of the asymmetric cutter are obtained using Eqs. (1)-(4), $$h_{ar} = 1.25 \cdot m \tag{1}$$

$$h_{fr} = 1 \cdot m \tag{2}$$

$$\rho_r = \frac{(\pi \cdot m/2) - (\tan\alpha_{od} + \tan\alpha_{oc}) \cdot h_{ar}}{(1/\cos\alpha_{od}) + (1/\cos\alpha_{oc}) - (\tan\alpha_{od} + \tan\alpha_{oc})} \tag{3}$$

$$h_0 = h_{ar} - \rho_r, \tag{4}$$

where $h_{ar}$ is addendum coefficient of the asymmetric cutter,
m is the module of the asymmetric cutter,
$h_{fr}$ is dedendum coefficient of the asymmetric cutter,
$\rho_r$ is the root fillet coefficient of the asymmetric cutter,
$\alpha_{od}$ is a first pressure angle defining a first face (i.e., a first drive side) of the asymmetric teeth, $\alpha_{od}$ is a second and different pressure angle defining a second face (i.e., a second drive side) opposite the first face of the asymmetric teeth, and
$h_0$ is the location of the root fillet center. The involute profiles for both the drive and coast side of the teeth can be obtained using Eqs. (5)-(7). These equations are represented in a generic form for any involute side of the teeth, changing the values of $r_b$ and $\theta_g$ for the drive or coast yields respectively the corresponding involute profiles as shown in $$x = (\sin\theta_g - \theta_g \cdot \cos\theta_g) \cdot r_b \cdot \cos\theta_g - (\cos\theta_g + \theta_g \cdot \sin\theta_g) \cdot r_b \cdot \sin\theta_g \tag{5}$$

$$y = (\sin\theta_g - \theta_g \cdot \cos\theta_g) \cdot r_b \cdot \sin\theta_g + (\cos\theta_g + \theta_g \cdot \sin\theta_g) \cdot r_b \cdot \cos\theta_g \tag{6}$$

$$\theta_g = inv\alpha_0 + \frac{\pi}{2 \cdot z}, \tag{7}$$

where x is the x-coordinate of the involute curve,
y is the y-coordinate of the involute curve,
$\theta_g$ is Involute curve co-ordinate parameter,
$r_b$ is the base circle radius,
$\alpha_0$ is the pressure angle, and
z is the number of teeth per gear. Similar to the construction of the involute profiles, the trochoid profiles of the teeth are obtained using Eqs. (8)-(10), as shown in FIGS. 8A and 8B.

$$x = (r_0 - h_0) \cdot \sin(\xi_g + v_g) - r_0 \cdot \xi_g \cdot \cos(\xi_g + v_g) - \left[\frac{r_0 \cdot \xi_g + h_0}{\sqrt{h_0^2 + r_0^2 \cdot \xi_g^2}}\right] \cdot \rho_r \cdot \sin(\xi_g + v_g) \tag{8}$$

$$y = (r_0 - h_0) \cdot \cos(\xi_g + v_g) + r_0 \cdot \xi_g \cdot \sin(\xi_g + v_g) + \left[\frac{r_0 \cdot \xi_g - h_0}{\sqrt{h_0^2 + r_0^2 \cdot \xi_g^2}}\right] \cdot \rho_r \cdot \sin(\xi_g + v_g) \tag{9}$$

$$v_g = \frac{\pi}{2 \cdot z} + \frac{h_0 \cdot \tan a_g}{r_0} + \frac{\rho_r + b_n}{r_0 \cdot \cos\alpha_0}, \tag{10}$$

where x is the x-coordinate of the trochoid curve,
y is the y-coordinate of the trochoid curve,
$r_0$ is the pitch radius of the gear,
$\xi_g$ is the trochoid curve co-ordinate parameter, and
$b_n$ is backlash parameter for the gears. The value of $b_n$ controls the backlash in the gear pair generated; therefore setting its value to zero yields gears with zero backlash or dual flank contact.

Figure 9A:
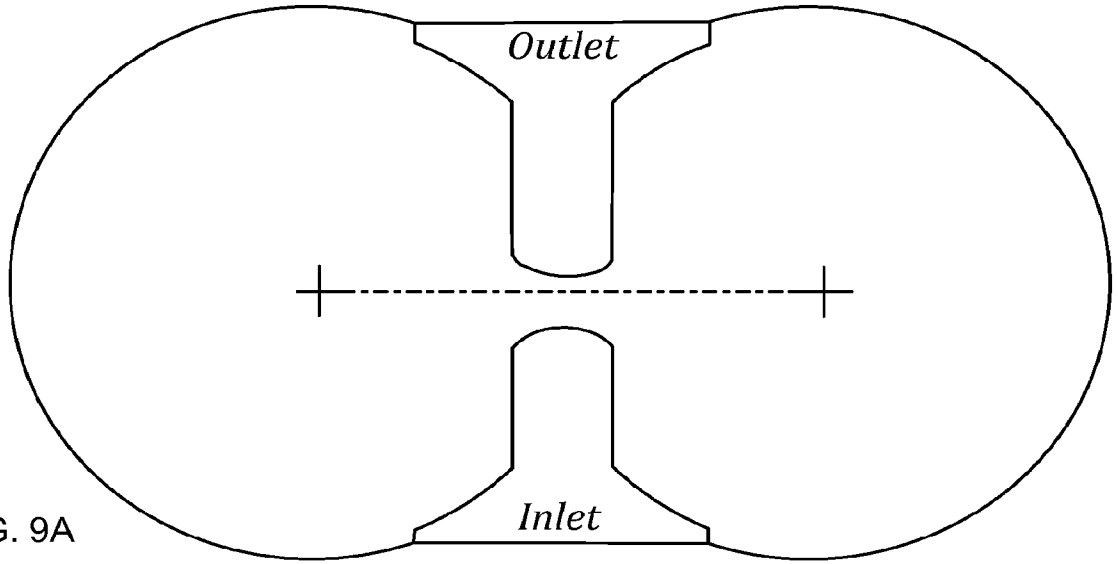
FIGS. 9A and 9B represent a two-winged structure provided on grooves provided on the sliders.
Figure 9B:
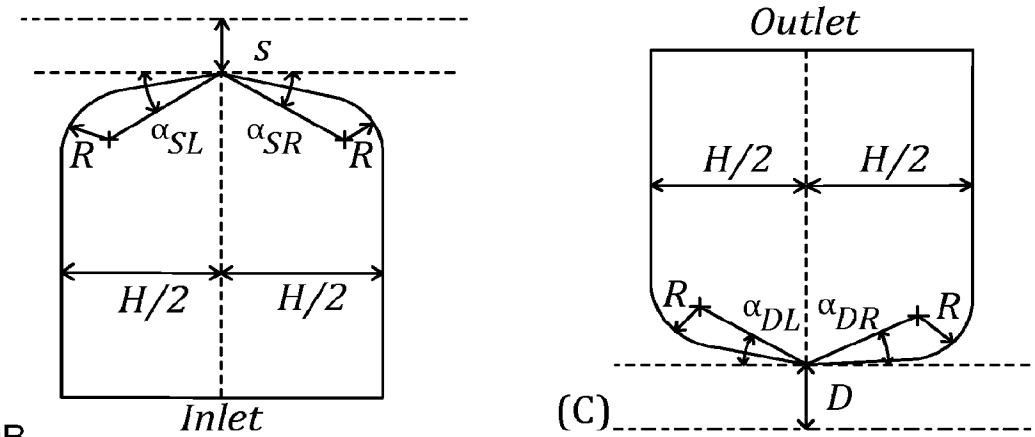

Having the analytical tool to develop the asymmetric teeth, we now turn our attention to the inlet and outlet groove profiles. In the VD-EGM, the grooves machined in the lateral bushings (or in the housing, for not pressure compensated designs) perform the important timing function of connecting tooth space volumes (TSVs) with the inlet or outlet environment when the TSV is trapped between points of contact. Therefore, they contribute in determining the amount of fluid displaced per revolution by every TSV. With an optimal crossport (simultaneous connection of the TSV with the inlet and outlet port), the grooves can also ensure minimal internal pressure overshoots and localized cavitation effects during the transition of TSV from/to the low pressure and high pressure regions. For the asymmetric gear profile, a particular "two-winged" structure of the grooves was developed as provided in FIG. 9A. The different parameters which control the shape of the grooves are depicted in FIGS. 9A and 9B. The main intent for using such a two winged architecture with four angular controls (a's) is to control the influence of the pressure angles (drive and coast side) of the gear profiles on the performance of the machine. Particular emphasis is placed on the feasibility of machining the grooves using the conventional milling process for prototyping. As can be seen from FIGS. 9A and 9B, the radius 'R' of the milling tool is taken into consideration, so that the results of the optimization process can be directly prototyped without any additional consideration based on manufacturability. It should be noted that the groove profiles displayed in the FIGS. 9A and 9*b* are not the only designs which are applicable to the design of VD-EGM. Other groove profiles can be used as long as they are machined on a movable slider.

Figure 10A:
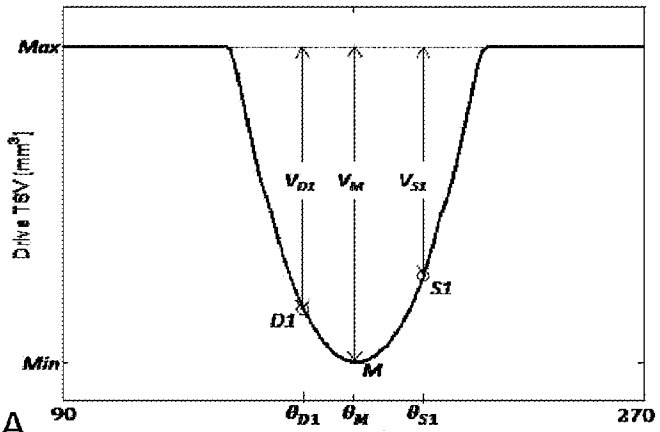
FIGS. 10A and 10B represent graphs of tooth space volume in $mm^3$ vs. angle in degrees for location of the points associated with angular locations at which fluid in the tooth space volume is trapped between the contact points between the gears.
Figure 10B:
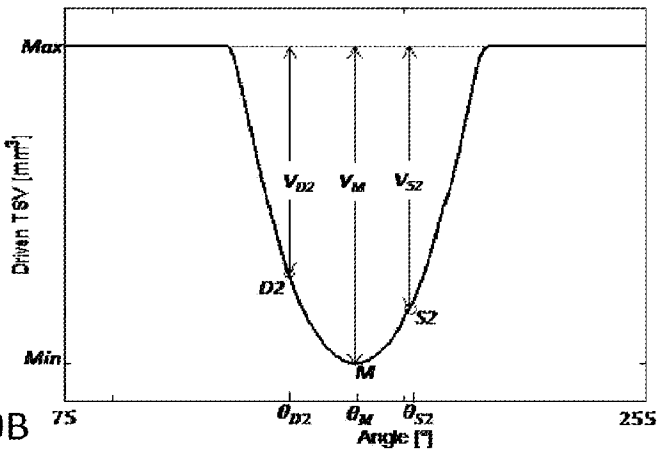

The maximum reduction in flow delivery (also referred as minimum displacement condition) can be calculated by investigating the location of the points D and S (which define the angular locations at which the fluid in the TSV is trapped between the contact points between the gears) in the curve that characterize the volume of each TSV, as shown in FIGS. 10A and 10B. Due the asymmetric nature of the gears, the location of the points 'D' and 'S' are not symmetric about the point 'M' (angular location which the trapped TSV is at a minimum) unlike gears with symmetric involute teeth. It can be seen however that the angular range remains at the same point ($\theta_{D2}-\theta_{S2}=\theta_{D1}-\theta_{S1}$) though the actual position at which these points occur differs as seen in FIGS. 10A and 10B,
where $\theta_{D2}$ is the angular location at which the fluid in the tooth space volume begins to be trapped between the points of contact of the slave gear,
$\theta_{S2}$ is the angular location at which the fluid in the tooth space volume seizes to be trapped between the points of contact of the slave gear,
$\theta_{D1}$ is the angular location at which the fluid in the tooth space volume begins to be trapped between the points of contact of the drive gear, and
$\theta_{S1}$ is the angular location at which the fluid in the tooth space volume seizes to be trapped between the points of contact of the drive gear. Since dual flank configuration is imposed on all the gears, and in order to expand further the angular range of the trapped volume, both the drive TSV and slave TSV behave as two independent displacing chambers which are not connected to each other. Therefore, to maximize the full potential in achieving the reduction in displacement, the switch of the connection of the drive TSV from the delivery to suction should occur at point S1, and at point S2 for the TSV on gear 2 since both TSVs operate as separate displacement chambers due to the introduction of dual flank configuration.

The resultant minimum displacement achievable can be expressed as an average of the ones provided by the drive and the slave TSVs independently. The minimum displacement achievable can be calculated using Eq. (11)

$$\beta = \frac{\beta_{drive} + \beta_{driven}}{2} = \frac{V_{S2} + V_{S1}}{2 \cdot V_M} \tag{11}$$

where $\beta_{drive}$ is minimum displacement % of the drive tooth space volume, $\beta_{driven(Slave)}$ is minimum displacement % of the slave tooth space volume, la $V_{s2}$ is volume of the slave tooth space volume at Point S, $V_{s1}$ is volume of the drive tooth space volume at Point S, and $V_M$ is volume of the minimum tooth space volume.

Figure 11A:
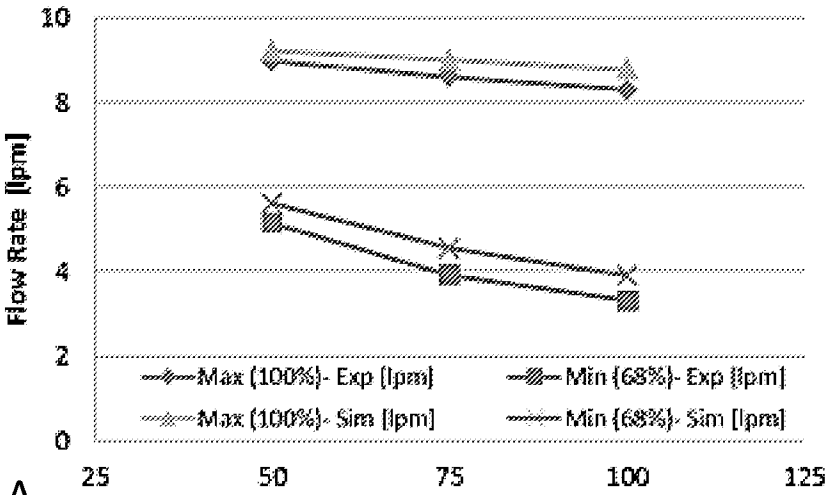
FIGS. 11A and 11B are graphs of flow rate in 1 pm v. pressure in bars for flow rate proportionally reduction at minimum displacement conditions for two different flow rate ranges.
Figure 11B:
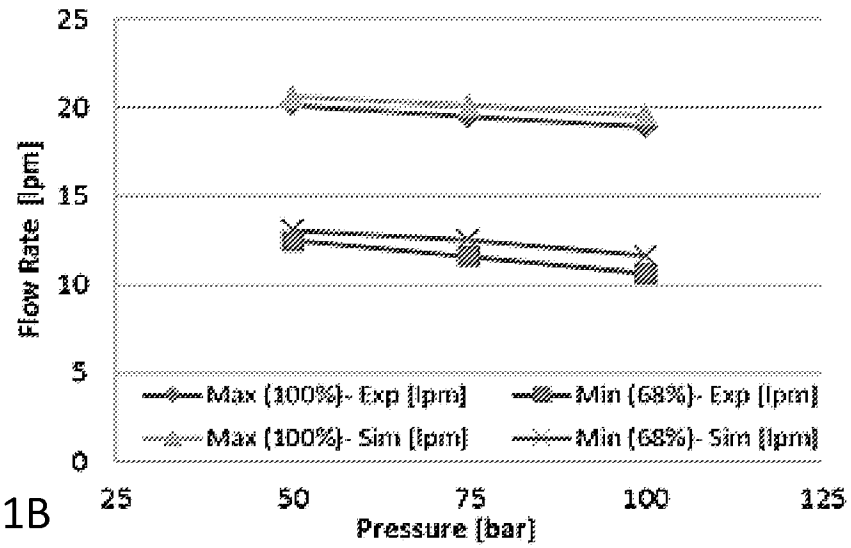

Experimental results of various configurations are provided with reference to FIGS. 11A and 11B. It can be seen from FIGS. 11A and 11B that, according to at least one embodiment the flow rate proportionally (68%) reduces at minimum displacement condition as compared to those at full or maximum displacement, however other reduction amounts may be possible depending on gear diameter specification. A good agreement between simulated data and measurements can be observed from these figures. However, at both displacements there is a small offset between the two curves which can be explained by the low tolerance of the process used to realize the gears. The gears do not permit to strictly maintain the dual flank contact conditions for all teeth into mesh; as a consequence, an imperfection in achieving zero backlash between the gears is introduced, and a certain amount of bypass leakage is introduced from the high pressure to the low pressure side through the TSVs hence causing a lower volumetric performance in the experiments.

Figure 12A:
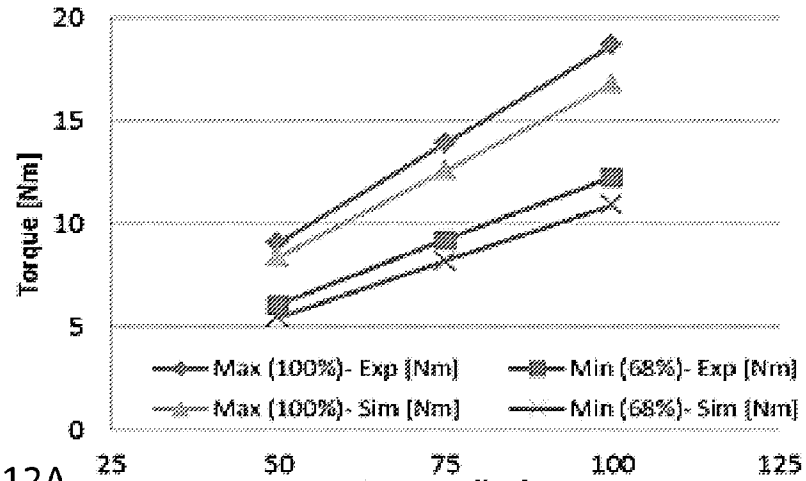
FIGS. 12A and 12B are graphs of torque measured in Nm vs. pressure measured in bars for input shaft torque proportionally reduction at the minimum displacement conditions of FIGS. 11A and 11B.
Figure 12B:
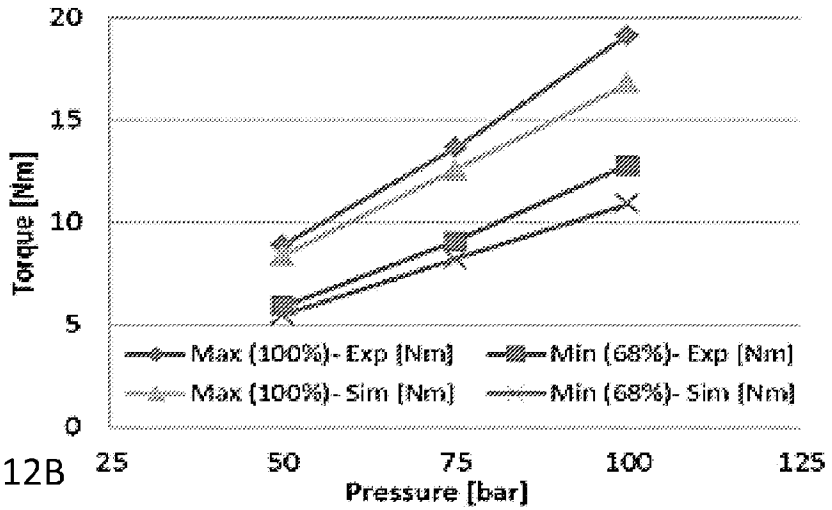

FIGS. 12A and 12B represent the input shaft torque validation. It can be seen that the input shaft torque reduces proportionally at minimum displacement. In one embodiment, approximately 32% reduction in torque is obtained at all the operating conditions tested for minimum displacement.

Figure 13A:
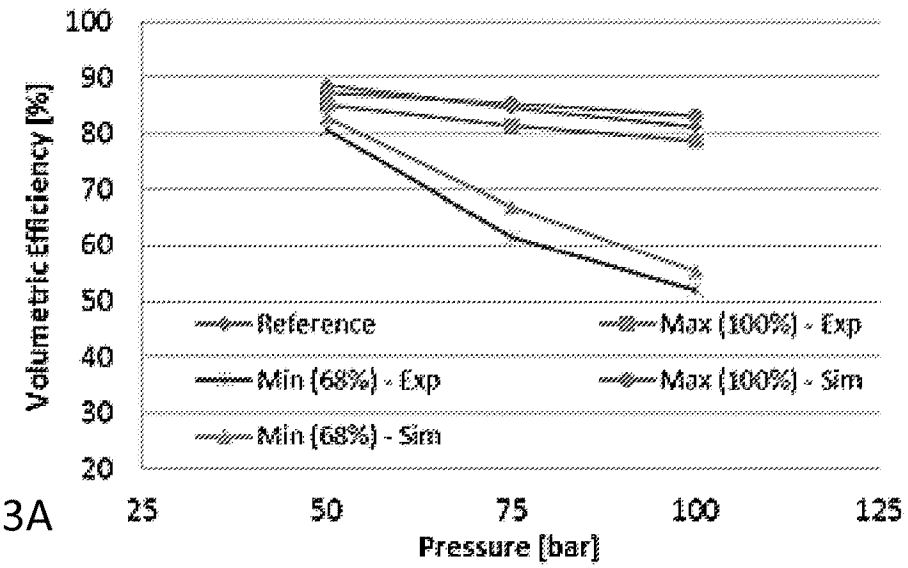
FIGS. 13A and 13B are graphs of volumetric efficiency measured in % vs. pressure measured in bars at the minimum displacement conditions of FIGS. 11A and 11B.
Figure 13B:
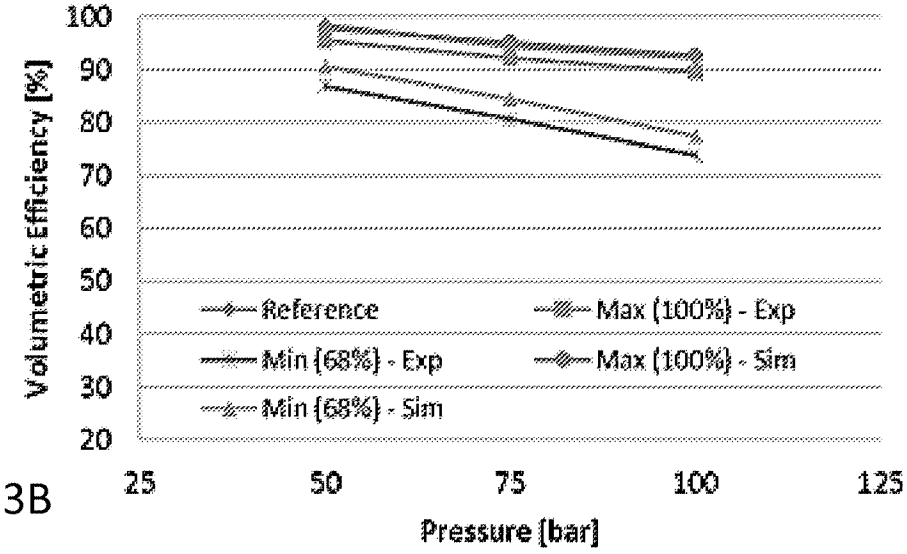

The validations for volumetric efficiency are provided in FIGS. 13A and 13B. The curve with diamond dots represents the performance of the reference commercial EGM (of the same displacement). It can be noticed that the volumetric performance at maximum displacement, as shown by the curve with square dots matches very closely to that of the reference design (shown by the curve with diamond dots). It should also be noted that the volumetric efficiency for all the pressures at maximum and minimum displacement is higher for 2000 rpm (FIG. 13B) as compared to 1000 rpm (FIG. 13A), this is because the maximum speed at which the casing was broken in was 2000 rpm and hence the gears are capable of achieving better radial sealing thereby leading to better volumetric performance at 2000 rpm.

As expected, it can be seen from FIGS. 13A and 13B that the volumetric efficiency at minimum displacement is lower than the volumetric efficiency at maximum displacement. This is due to the internal leakages (at the tip of the teeth and in the lateral side of both gears) are most prominently dependent on the pressure and hence have a larger influence for the efficiency at lower displacement. The trends of simulated volumetric efficiency at minimum displacement matches closely to that of the measured values.

Returning to FIG. 2, EGM 100 according to the present disclosure can be operated as a pump, wherein the inlet 124 is coupled to a low pressure supply of fluid (not shown) and the outlet 122 is coupled to a downstream apparatus (not shown) that is being actuated by the pump, and where the drive gear 114 is driven by an external actuator (e.g., electric motor, internal combustion engine etc.) (not shown). Alternatively, the EGM 100 can be operated as a motor, wherein the inlet 124 is coupled to a high pressure supply of fluid and the outlet 122 is coupled to a fluid reservoir (not shown) where the drive gear 114 drives an external apparatus (not shown).

Furthermore, the sliders 120A and 120B can be actuated by a pressure differential apparatus that uses pressure differential at the outlet 122 and the inlet 124 to position the sliders to maintain a desired volume displacement. Alternatively, the sliders 120A and 120B can be operated by an actuator such as a stepper motor that is controlled by a controller via a processor that senses outlet pressure at the outlet 122 and inlet pressure at the inlet 124 and adjusts the position of the sliders 120A and 120B accordingly.

Figure 14:
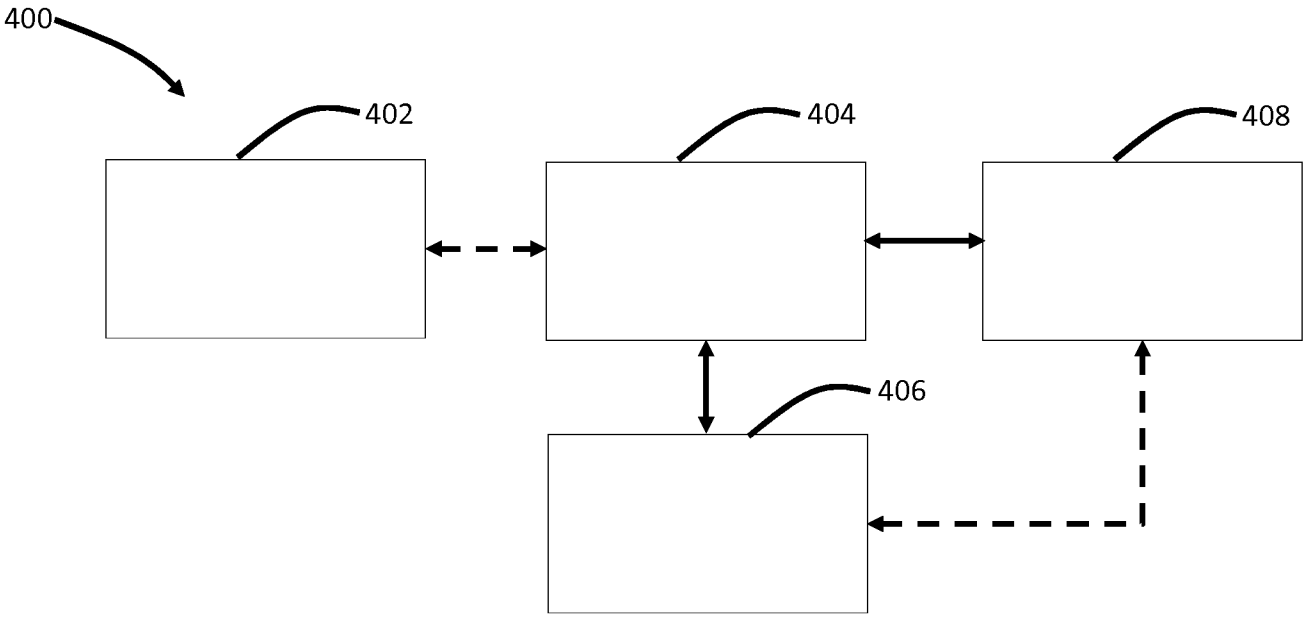
FIG. 14 is a block diagram representation of a system according to the present disclosure.

The EGM according to the present disclosure can also be operated in a system, where the EGM is either operated as a pump or a motor. Referring to FIG. 14, such a block diagram of such a system 400 is depicted. The system 400 includes a mechanism 402 coupled to the drive gear (similar to the drive gear 114 of FIG. 2) of an EGM 404, the mechanism is configured to (i) drive the EGM 404 when the EGM 404 is configured as a pump, or (ii) be driven by EGM 404, when the EGM 404 is configured to be operated as a motor. Therefore, the connection between the mechanism 402 and the EGM 404 is provided in dashed format. The EGM 400 is fluidly coupled to a fluid supply 406. The EGM 404 is also optionally fluidly or mechanically coupled to a load actuator 408 configured to facilitate actuation of a load. The load actuator 408 may optionally be coupled to the fluid supply 406.

Those skilled in the art will recognize that numerous modifications can be made to the specific implementations described above. The implementations should not be limited to the particular limitations described. Other implementations may be possible.

The invention claimed is:

1. An external gear machine (EGM), comprising:

a housing;

an inlet formed in the housing and configured to receive fluid from a supply;

a drive gear disposed in the housing and configured to be (i) driven by a mechanism when the EGM is operated as a pump, or (ii) drive an external mechanism when the EGM is operated as a motor, the drive gear having a plurality of teeth;

a slave gear disposed in the housing having a plurality of teeth and configured to be driven by the drive gear, the drive gear configured to engage the slave gear in an angular mesh zone, tooth space volumes defined by tooth spaces between each two consecutive teeth of the drive gear and each two consecutive teeth of the slave gear configured to receive volumes of fluid from the inlet via an inlet fluid communication channel as the corresponding teeth rotate about the inlet;

an outlet formed in the housing and configured to receive at least some of the volume of fluid via an outlet fluid communication channel when the corresponding tooth space volumes in the angular mesh zone decrease as the corresponding teeth of the drive gear and slave gear come into contact with each other;

a first slider defining the inlet fluid communication channel and the outlet fluid communication channel, selective positioning of the first slider configured to vary net operational volumes of fluid communication between the inlet and the outlet, for a given rotational speed of the drive gear; and a second slider defining a secondary inlet fluid communication channel and a secondary outlet fluid communication channel such that selective positioning of the second slider provides fluid pressure balancing with the inlet fluid communication channel and the outlet fluid communication channel in order to vary net operational volumes of fluid communication between the inlet and the outlet for a given rotational speed of the drive gear.

2. The external gear machine of claim 1, the teeth are asymmetrical.

3. The external gear machine of claim 2, the asymmetry of each tooth is defined by a first pressure angle defining a first face of the tooth and by a second and different pressure angle defining a second face of the tooth, opposite the first face.

4. The external gear machine of claim 3, a ratio of the first pressure angle to the second pressure angle is between about 1 and 1.81.

5. The external gear machine of claim 1, the second slider and the first slider are operatively coupled to each other.

6. The external gear machine of claim 1, the first slider is operated by an electromechanical actuator.

7. The external gear machine of claim 6, the electromechanical actuator is a stepper motor.

8. The external gear machine of claim 6, the electromechanical actuator is a solenoid.

9. The external gear machine of claim 1, the first slider is operated by a mechanical actuator configured to move the first slider based on one of (i) pressure differential between the inlet and the outlet, and (ii), pressure at the outlet.

10. A hydraulic displacement system, comprising:

a mechanism for (i) driving an external gear machine (EGM) when the EGM is configured to be a pump, or (ii) being driven by the EGM when the EGM is configured to be a motor;

a fluid supply; and the external gear machine comprising a housing, an inlet formed in the housing and configured to receive fluid from a supply, a drive gear disposed in the housing and configured to be (i) driven by the mechanism when the EGM is operated as a pump, or (ii) drive the mechanism when the EGM is operated as a motor, the drive gear having a plurality of teeth, a slave gear disposed in the housing having a plurality of teeth and configured to be driven by the drive gear, the drive gear configured to engage the slave gear in an angular mesh zone, tooth space volumes defined by tooth spaces between each two consecutive teeth of the drive gear and each two consecutive teeth of the slave gear configured to receive volumes of fluid from the inlet via an inlet fluid communication channel as the corresponding teeth rotate about the inlet, an outlet formed in the housing and configured to receive at least some of the volume of fluid via an outlet fluid communication channel when the corresponding tooth space volumes in the angular mesh zone decrease as the corresponding teeth of the drive gear and slave gear come into contact with each other, a first slider defining the inlet fluid communication channel and the outlet fluid communication channel, selective positioning of the first slider configured to vary net operational volumes of fluid communication between the inlet and the outlet, for a given rotational speed of the drive gear, and a second slider defining a secondary inlet fluid communication channel and a secondary outlet fluid communication channel such that selective positioning of the second slider provides fluid pressure balancing with the inlet fluid communication channel and the outlet fluid communication channel in order to vary net operational volumes of fluid communication between the inlet and the outlet for a given rotational speed of the drive gear.

11. The hydraulic displacement system of claim 10, the teeth are asymmetrical.

12. The hydraulic displacement system of claim 11, the asymmetry of each tooth is defined by a first pressure angle defining a first face of the tooth and by a second and different pressure angle defining a second face of the tooth, opposite the first face.

13. The hydraulic displacement system of claim 12, a ratio of the first pressure angle to the second pressure angle is between about 1 and 1.81.

14. The hydraulic displacement system of claim 10, the second slider and the first slider are operatively coupled to each other.

15. The hydraulic displacement system of claim 10, the first slider is operated by an electromechanical actuator.

16. The hydraulic displacement system of claim 15, the electromechanical actuator is a stepper motor.

17. The hydraulic displacement system of claim 15, the electromechanical actuator is a solenoid.

18. The hydraulic displacement system of claim 10, the first slider is operated by a mechanical actuator configured to move the first slider based on one of (i) pressure differential between the inlet and the outlet, (ii), and pressure at the outlet.

19. An external gear machine (EGM), comprising:

a housing;

an inlet formed in the housing and configured to receive fluid from a supply;

a drive gear disposed in the housing and configured to be (i) driven by a mechanism when the EGM is operated as a pump, or (ii) drive an external mechanism when the EGM is operated as a motor, the drive gear having a plurality of teeth;

a slave gear disposed in the housing having a plurality of teeth and configured to be driven by the drive gear, the drive gear configured to engage the slave gear in an angular mesh zone, tooth space volumes defined by tooth spaces between each two consecutive teeth of the drive gear and each two consecutive teeth of the slave gear configured to receive volumes of fluid from the inlet via an inlet fluid communication channel as the corresponding teeth rotate about the inlet;

an outlet formed in the housing and configured to receive at least some of the volume of fluid via an outlet fluid communication channel when the corresponding tooth space volumes in the angular mesh zone decrease as the corresponding teeth of the drive gear and slave gear come into contact with each other; and a first slider defining the inlet fluid communication channel and the outlet fluid communication channel, selective positioning of the first slider configured to vary net operational volumes of fluid communication between the inlet and the outlet, for a given rotational speed of the drive gear, wherein the teeth are asymmetrical, and wherein the asymmetry of each tooth is defined by a first pressure angle defining a first face of the tooth and by a second and different pressure angle defining a second face of the tooth, opposite the first face.

* * * * *